US005906145A

United States Patent [19]

Shepherd

[11] Patent Number: 5,906,145

[45] Date of Patent: May 25, 1999

[54] ROOFING SHOVEL

[76] Inventor: John Shepherd, 308 Broad St., Middlebourne, W. Va. 26149

[21] Appl. No.: 09/032,032

[22] Filed: Feb. 27, 1998

Related U.S. Application Data

[60] Provisional application No. 60/048,438, Jun. 2, 1997.

[51] Int. Cl.[6] ..... E04D 15/00

[52] U.S. Cl. ..... 81/45; 173/128; 173/211; 299/37.5

[58] Field of Search ..... 81/45; 173/128, 173/211, 11, 13, 18; 299/37.5, 37.1, 37.3; 30/170; 15/93.1

[56] References Cited

U.S. PATENT DOCUMENTS

| | | | |
|---|---|---|---|
| 3,625,295 | 12/1971 | Gunning . | |
| 4,095,752 | 6/1978 | Pomeret et al. . | |
| 4,302,894 | 12/1981 | Emma . | |
| 4,505,340 | 3/1985 | Yantsen et al. . | |
| 4,858,503 | 8/1989 | Dike, Jr. . | |
| 4,932,480 | 6/1990 | Golsch | 227/130 X |
| 5,009,131 | 4/1991 | Alto et al. . | |
| 5,076,119 | 12/1991 | Wenz . | |
| 5,098,165 | 3/1992 | Jacobs et al. . | |
| 5,280,676 | 1/1994 | Fieni | 30/172 |
| 5,287,582 | 2/1994 | Kawai et al. | 30/169 X |
| 5,741,047 | 4/1998 | Ordonez | 30/170 X |

FOREIGN PATENT DOCUMENTS

| | | |
|---|---|---|
| 925 428 | 2/1955 | Germany . |
| 2 300 668 | 6/1974 | Germany . |

*Primary Examiner*—D. S. Meislin
*Attorney, Agent, or Firm*—Richard C. Litman

[57] ABSTRACT

An air pressure actuated shovel for removing shingles and attached nails from a roof to facilitate re-roofing. The shovel has an elongated handle with a finger actuated trigger mechanism attached to its top end and a shovel blade supporting an air hammer attached to its bottom. The trigger connects the air hammer and an external pneumatic power source via an air hose inside the handle so that when the trigger mechanism is squeezed, a reciprocating piston, driven by an air hammer, abuts the shovel blade to cause it to vibrate. The vibrating shovel blade effectively loosens shingles and nails from the roof of a building. The removal of shingles with the associated nails intact enhances safety due to the elimination of flying nails.

9 Claims, 3 Drawing Sheets

ROOFING SHOVEL

CROSS-REFERENCE TO RELATED APPLICATION

This application claims the benefit of U.S. Provisional patent application Ser. No. 60/048,438, filed Jun. 2, 1997.

BACKGROUND OF THE INVENTION

1. Field of the Invention

The present invention relates to a pneumatically actuated shovel. More specifically, the invention relates to a pneumatically actuated shovel for removing shingles and attached nails from a roof to facilitate re-roofing.

2. Description of Related Art

Commonly, when a house or other building has to be reroofed, it is necessary to first remove the existing roof materials. Removing these materials, namely the shingles and nails attaching them to the existing roof structure, is a difficult process which has traditionally been accomplished by forcing a shovel or a similar tool under the shingles to pry them loose along with the attached nails.

This requires a great deal of physical exertion and often results in many of the nails either being forcefully ejected from the roof structure so that they pose a danger as they fly through the air or remaining embedded in the roof structure so that they must be removed from the roof structure separately of the shingles. In either case the task of cleaning up the removed roofing materials is made more difficult because the nails have been separated from the shingles while being removed.

One way to reduce the effort involved and the tendency of the nails to be separated from the shingles during the removal of the roofing materials is to utilize vibrating or reciprocating and otherwise movable shovel type elements driven by a variety of power sources to pry the shingles and attached nails from the roof structure. A number of tools having shovel type elements of the above described type have been disclosed in the prior art.

U.S. Pat. No. 4,095,752, issued Jun. 20, 1978 to Jean-Claude Pomeret and Henry Bonnevaux, discloses a motorized shovel apparatus having a cart mounted swiveling support arm, a pneumatic motor driven winch assembly, and a shovel with a pneumatic vibrator disposed between the handle and the shovel blade. The shovel, which is suspended from the winch assembly on the support arm, has controls in its handle adapted to operate the pneumatic motor driven winch assembly and the pneumatic vibrator so that the shovel may be easily operated with a minimum of physical effort. The apparatus of Pomeret and Bonnevaux is intended to be used to dig holes in the ground in cases where the use of a large mechanical shovel is not economical or is not possible due to lack of space.

U.S. Pat. No. 5,009,131, issued Apr. 23, 1991 to Brian J. Alto and Gregory F. Alto, discloses a long handled tool adapted for stripping roof shingles which utilizes a reciprocating blade slidably mounted over a shingle lifting plate to pry shingles from a roof structure and cut the shingle nails. When a trigger on the end of the handle of the tool is squeezed, an electric motor and gearing assembly connected to an offset crank causes the blade to reciprocate along an axis perpendicular to the leading edge of the lifting plate. The tool is effective at removing shingles and nail heads, but leaves the body of the nail embedded in the roof structure.

German Patent Number 925,428, issued Mar. 21, 1955, discloses another device which utilizes a motor and gearing assembly connected to an offset crank to reciprocate a blade member in front of the device.

U.S. Pat. No. 4,858,503, issued Aug. 22, 1989 to John H. Dike, Jr., discloses a long handled shingle removing tool having a pivoting shovel element on the bottom end of the handle which is actuated by a trigger on the top end of the handle. The shovel element is pivoted upwardly by a pneumatic drive attached thereto to pry the shingles from the roof structure after the shovel element has been forced under a group of shingles.

U.S. Pat. No. 5,076,119, issued Dec. 31, 1991 to Steven C. Wenz, discloses a roof shingle removing apparatus having a wheeled shovel like prying member with a blade attached to its forward edge. The blade on the apparatus of Wenz reciprocated along an axis parallel to the leading edge of the shovel like member which is adapted to cut the nail heads to allow the shingles to be easily removed.

U.S. Pat. No. 5,098,165, issued Mar. 24, 1992 to James L. Jacobs and Larry D. Rogers, discloses a wheeled cart connected to a roof mounted guide system that allows the roof to be traversed at various positions along different travel paths. The cart has a reciprocating blade attached to its forward edge that follows the contour of the roof structure to dislodge shingles and nails therefrom. The apparatus of Jacobs and Rogers relies on an electric motor to reciprocate the blade and a complicated blade support assembly to insure that the blade follows the contours of the roof structure.

German Patent Number 2,300,668, issued Jan. 8, 1974, discloses another device for removing materials from a surface. The device includes a reciprocating plate which pries beneath the surface of the material being removed. The above mentioned device is specifically adapted for removing carpeting from a floor and has a spiked wheel and guide assembly which draws the carpet upward after it has been pried from the floor.

U.S. Pat. No. 4,302,894, issued Dec. 1, 1981 to Sam F. Emma, discloses a wheeled device having a long handle extending upward from its base and a movable shovel like member extending forward therefrom. The shovel member on the device of Emma is adapted to pivot downward to dump the material held in the shovel member.

U.S. Pat. No. 5,505,340, issued Mar. 19, 1985 to Yantzen et al. and U.S. Pat. No. 3,625,295, issued Dec. 7, 1971 to Samuel D. Gunning, disclose devices having pneumatically driven reciprocating contact elements extending therefrom. Both devices are adapted for breaking up concrete, asphalt, rock and the like in congested areas.

However, none of the prior art discloses a shovel having a pneumatically driven reciprocating shovel blade which is specifically adapted to remove roofing shingles and attached nails without separating them from each other.

None of the above inventions and patents, taken either singly or in combination, is seen to describe the instant invention as claimed.

SUMMARY OF THE INVENTION

The present invention is a shovel adapted to be used to remove roofing materials with significantly less effort than conventional means and without separating the majority of the nails from the shingles. The shovel comprises a handle, a shovel blade, a trigger mechanism, and an air hammer. The handle is an elongate hollow cylinder having the trigger mechanism attached to its rearward end, the shovel blade attached to its forward end, and an air hose housed therein to connect the trigger mechanism and the air hammer. The shovel blade has a generally flat leading edge adapted for removing roofing materials and a rearward shank. A bracket member, extending rearward from the shovel blade, is adapted to slidably connect the shovel blade and the handle for reciprocal movement of the shovel blade. An air hammer is slidably supported within the bracket. Extending from the forward end of the air hammer is a reciprocating drive rod with a pair of washers encircling its distal end.

In order to operate the shovel of the present invention, the trigger mechanism must first be connected to an external pneumatic power source. Then the air hammer may then be actuated by squeezing the trigger mechanism. This causes the washers on the drive rod to contact the shank of the shovel as the drive rod reciprocates, thereby causing the shovel blade simultaneously to reciprocate.

Accordingly, it is a principal object of the invention to provide a shovel having a vibrating shovel blade adapted to remove roofing materials.

It is another object of the invention to provide a shovel having a vibrating shovel blade driven by an air hammer connected to an external pneumatic power source.

It is a further object of the invention to provide a shovel which enhances safety by allowing shingles and nails to be removed from a roof structure without separating the nails from the shingles, thereby eliminating potentially dangerous flying nails.

Still another object of the invention is to provide a shovel with a pneumatically driven vibrating blade which is easy to assemble and disassemble for repair and other purposes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
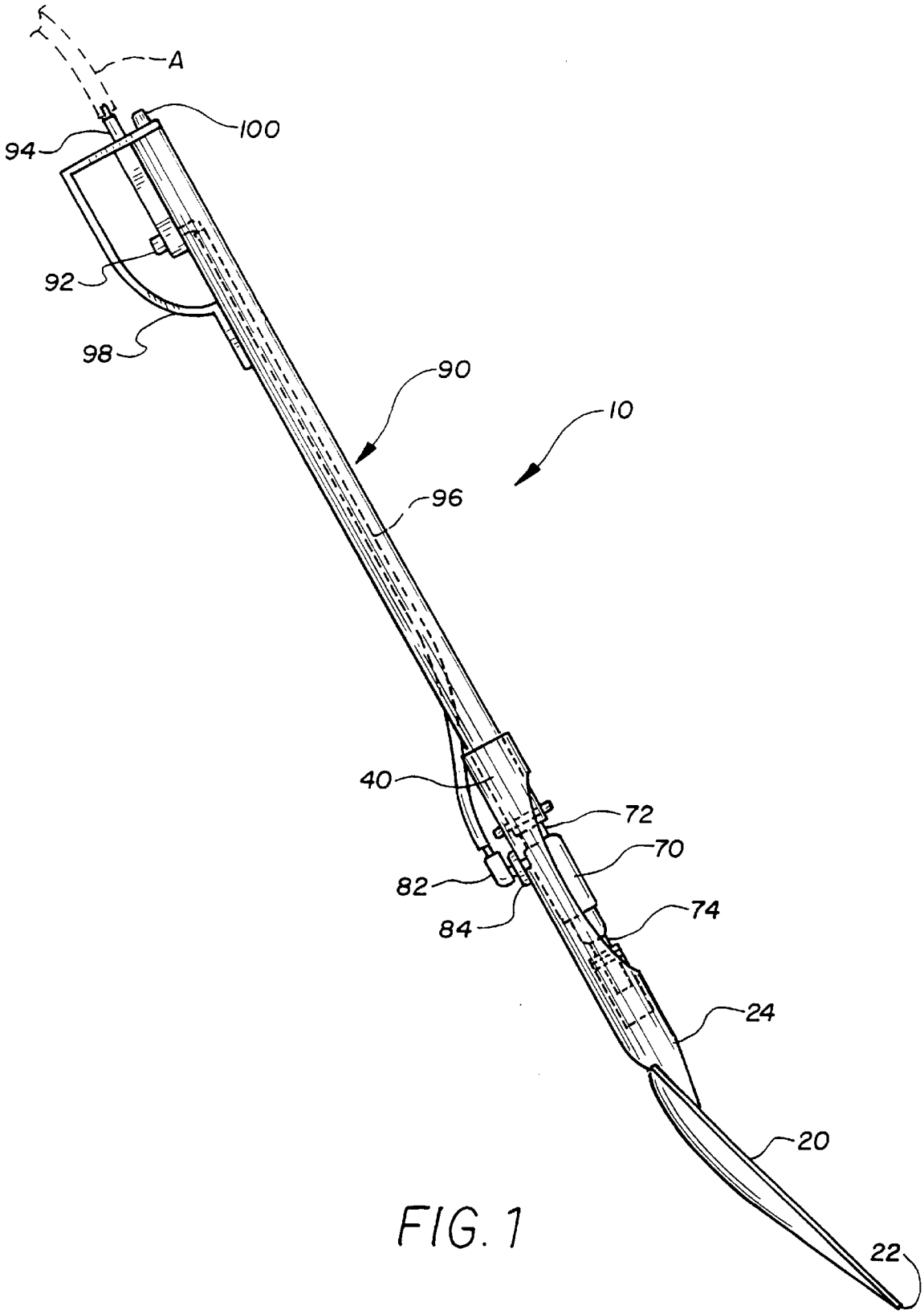
FIG. 1 is a perspective view of the roofing shovel of the present invention.

Referring to the drawings, FIG. 1 illustrates the pneumatically powered shovel 10 which is intended to be used to remove shingles and nails from an attached roof structure. The shovel 10 includes a handle 90, a shovel blade 20, a trigger mechanism 92, and an air hammer 70, arranged so that the air hammer 70 causes the shovel blade 20 to move rapidly in a reciprocating motion on the forward end of the handle 90 when the trigger mechanism 92 is squeezed.

The handle 10 forms an elongate hollow cylinder intended to be gripped adjacent its rearward end and having a bumper 72 made of an elastomeric material fixedly attached to its forward end. The bumper may also be fitted to the air hammer 70. Disposed through the diameter of the handle 90 adjacent its forward end is a removable pin 36 which serves to hold the shovel blade 20 on the handle 90 in a manner to be described hereinafter.

Figure 2:
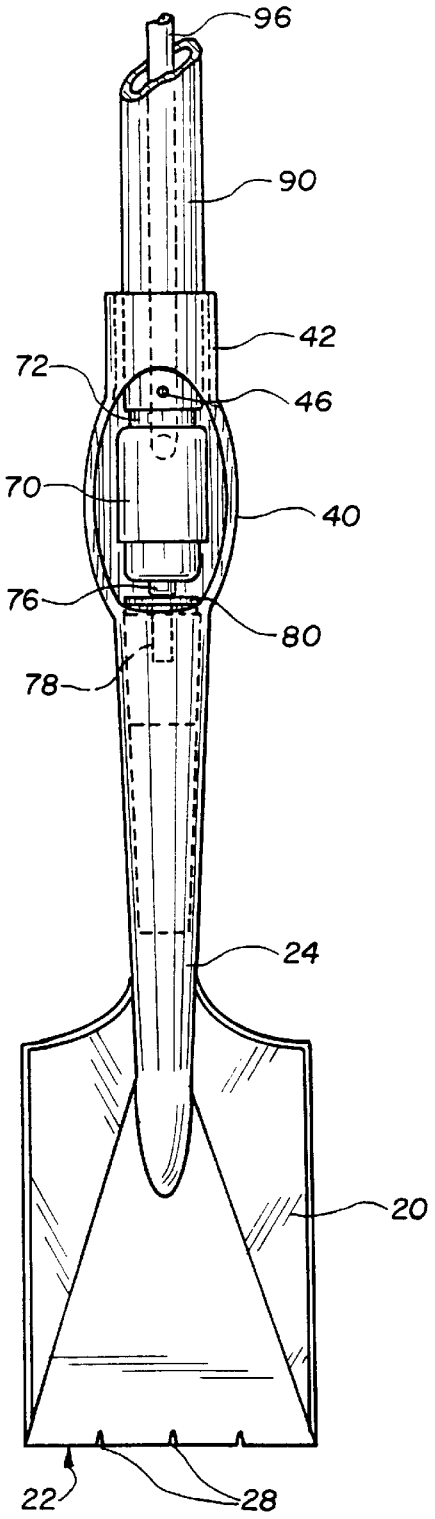
FIG. 2 is a front plan view of the roofing shovel of the present invention with the shovel blade in a normal position.

Referring now to FIG. 2, the shovel blade 20 is specifically adapted for removing roofing materials in that it has a straight and flat leading edge 22 which is tapered to slide easily under a roof shingle. The leading edge 22 of the shovel blade 20 has a plurality of spaced notches 28 formed therein which may interfit with the shaft of a nail to facilitate its removal. The rearward end of the shovel blade 20 is in the form of a hollow and generally cylindrical shank 24 having a lining 26 made of an elastomeric material.

Fixed to the rearward end of the shank 24 are a pair of brackets 40 which extend rearwardly therefrom. Together the brackets 40 define a substantially semicylindrical space which is open at its top side and which has a longitudinally running slot (not shown) along its bottom side, as can be seen in FIG. 2. The brackets 40 are adapted to slidably support the air hammer 70 therebetween.

The rearward ends of the brackets 40 are integrally joined together for form a collar 42 having an internal diameter which is slightly larger than the diameter of the handle 90 and slightly smaller than the length of the pin 46. This arrangement allows the collar 42, and thereby the brackets 40 and the shovel blade 20, to be slidably supported on the handle 90 by placing the collar 42 around the forward end of the handle 90 and then inserting the pin 46 through the handle 90 in front of the collar 42 to prevent the collar 42 from sliding off the handle 90. This can also be seen in FIG. 2.

The air hammer 70 is placed between the brackets 40 so that the reciprocating drive rod 74 extending therefrom extends into the shank 24. The drive rod 74 has a base portion 76 and a distal end 78 having a smaller diameter than the base portion 76. Secured to the distal end 78 of the drive rod 74 are a pair of washers 80 having an internal diameter slightly greater than the diameter of the distal end 78 of the drive rod 74 and smaller than the diameter of the base portion 76 of the drive rod 74, and having an external diameter larger then the internal diameter of the lining 26 of the shank 24 so that the washers 80 are sandwiched between the base portion 76 of the drive rod 74 and the lining 26 of the shank 24.

In order to cause the drive rod 74 of the air hammer 70 to reciprocate, the air hammer 70 must be connected to an external air line A. This is accomplished via the trigger mechanism 92 and an internal air line 96.

Referring back to FIG. 1, the trigger mechanism 92, which is fixed to the handle 90 adjacent the rearward end thereof, controls the flow of air from the external air line A into the internal air line 96. Extending from the rearward end of the trigger mechanism 92 is an air inlet 94 adapted to have the external air line A connected thereto. The internal air line 96 leads from the end of the trigger mechanism 92 opposite the air inlet 94, through the interior of the handle 90 to a point above collar 42, where the internal air line 96 exits the interior of the handle 90 to join an L-shaped pneumatic connector 82 adapted to be removably connected to the air hammer 70 through the slot between the bottom sides of the brackets 40. An elastomeric guard 84 is placed around the pneumatic connector 82 at the point where it passes through the slot to prevent unnecessary wear on the pneumatic connector 82. By connecting the air hammer 70 to the external air supply in the above described fashion, the drive rod 74 will reciprocate upon actuation of the trigger mechanism 92 which opens communication between a pressurized air source (i.e., a compressor) and the air hammer 70.

Also attached to the rearward end of the handle 90 is a guard 98 and an adjustable valve 100. The guard 98 extends around the trigger mechanism to prevent the accidental actuation thereof and the adjustable valve 100 is connected to the trigger mechanism to regulate the amount of pressurized air may be vented from the trigger mechanism 92. This allows the pressure of the air in the internal air line 96 to be lowered, as desired, from the pressure of the air in the external air line A so that the operation of the air hammer 70 may be adjusted.

It should be noted that the shovel 10 may be easily disassembled because the L-shaped pneumatic connector 82 is removably connected to the air hammer 70, the pin 46 is removable, and the air hammer 70, drive rod 74, and washers are not fixed to the brackets 40, the shank 24, or the handle 90. This allows maintenance or replacement of any of the shovel parts to be easily accomplished.

Figure 3:
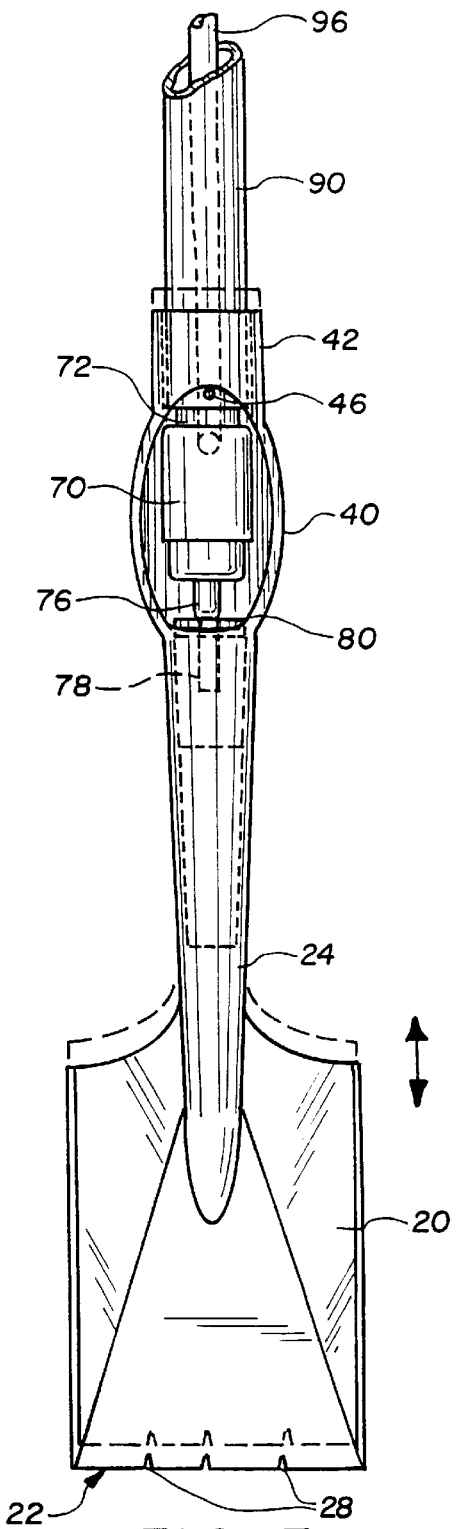
FIG. 3 is a front plan view of the roofing shovel of the present invention with the shovel blade in an extended position.

Referring now to FIG. 3, the operation of the shovel 10 may be described in the following manner. As the shovel 10 is pressed forward using the handle 90 to wedge the shovel blade 20 between a roof structure and a shingle attached thereto, the forward end of the handle 90 urges the air hammer 70 forward until washers 80 on the distal end 78 of the drive rod 74 are firmly sandwiched between the base portion 76 of the drive rod 74 and the lining 26 of the shank 24. This position is illustrated in FIG. 2 and in dashed lines in FIG. 3. At this point, when the trigger mechanism 92 is actuated, the drive rod 74 will move forward from the air hammer 70, forcing the washers 80 forward against the lining 26 of the shank 24 and thereby urging the shovel blade 20 forward and causing collar 42 to slide forward on the handle 90. This position is illustrated in solid lines in FIG. 3. Then as the drive rod 74 completes its reciprocating motion by moving backward into the air hammer 70, the forward pressure exerted on the handle 90 will cause the collar 42 to slide backward on the handle 90, thereby allowing the handle 90 to urge the air hammer 70 forward relative to the shank 24 until the washers are again firmly sandwiched between the base portion 78 of the drive rod 74 and the lining 26 of the shank 24, thus completing the reciprocating motion of the shovel blade 20.

Figure 4:
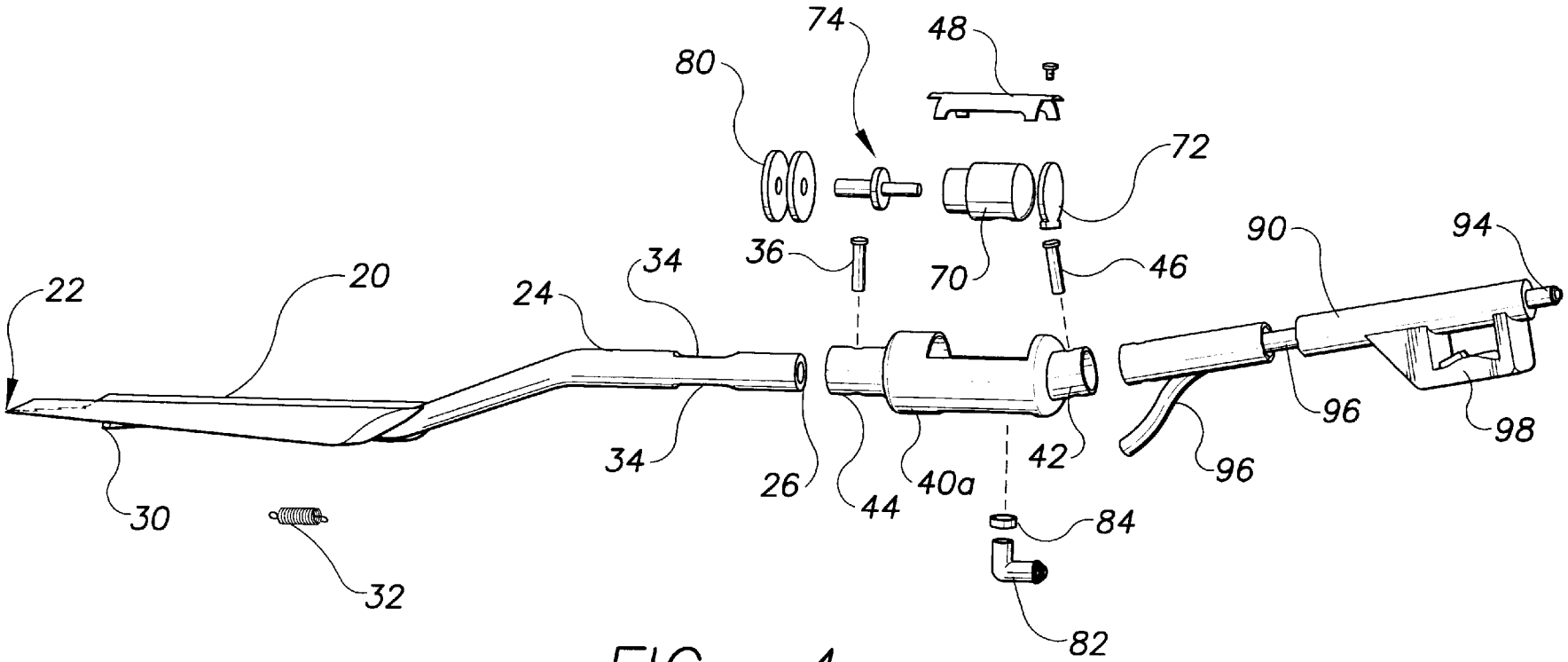
FIG. 4 is an exploded view of a preferred alternative embodiment of a roofing shovel of the present invention.

A preferred alternative embodiment of the roofing shovel of the present invention is shown in FIG. 4. As described above, a shovel blade 20 has a leading edge 22 adapted for removing roofing shingles and a rearward hollow shank 24. The bottom of the shovel blade 20 may be provided with a fulcrum 30 which is used in prying operations for greater leverage. The fulcrum 30 may be simply a small beam parallel to the leading edge 22 of the shovel blade on which the shovel blade can pivot. The shank 24 has two longitudinal slots 34 located on the shank 24, 180° from each other. The rearward end of the shank 24 has a reinforced and reduced diameter 26 relative to the rest of the shank 24. The shank 24 is fitted into a separate, singular, and cylindrical bracket 40*a*. At its forward end, the bracket 40 has a shank receiving collar 44 into which the shank 24 of the shovel blade 20 fits. The shank receiving collar 44 has two apertures, each of which is aligned with one of the slots 34 on the shank 24. A pin 36 passes through one aperture, then through the shank 24, and finally through the other aperture. In this manner, the shovel blade 20 is secured to the bracket 40*a* such that the blade 20 is free to reciprocate in a longitudinal direction. A spring 32 passes within the shank 24 of the shovel blade 20 connecting a hook on the shovel blade 20 and the pin 36 to bias the shovel blade 20 to a closed position.

The reciprocal motion of the shovel blade 20 is once again caused by a drive rod 74 driven by an air hammer 70. The base end 76 of a drive rod 74, broadened by two washers 80, engages the reduced diameter portion 26 of the shovel shank 24. A reduced diameter distal end 78 of the drive rod 74 is seated within and driven by an air hammer 70 which is capped by a bumper 72. When the air hammer 70 is activated, the drive rod 74 is thrust forward, pushing against the shank 24 of the shovel 20, acting against the bias of the spring 32. The entire drive arrangement is housed within the cylindrical bracket 40.

The bracket 40 has a removable access panel 48 through which all components of the drive arrangement may be removed and replaced. Opposite the access panel 48 is a cutout for allowing for a connection 82 to an air hose 96 as previously discussed. Also important in this preferred embodiment is a handle receiving collar 42. This collar 42 is an integral part of the bracket 40, found at its rearward end, adapted for receiving the handle 90 to complete the shovel 10. To reduce back strain, this collar 42 is, most preferably, angled slightly upward relative the shank 24 of the shovel blade 20. The attached handle 90 contains an internal air hose 96 and associated parts, as previously discussed.

It is to be understood that the present invention is not limited to the embodiment described above, but encompasses any and all embodiments within the scope of the following claims.

I claim:

1. A hand held and operated pneumatic roofing shovel comprising:

a shovel blade, having an underside, a flat forward end and a rearward end;

a handle, having a forward end and a rearward end;

a bracket for slidably coupling said shovel blade to said handle having a forward end fixedly attached to the rearward end of said shovel blade, and a rearward end slidably coupled to the forward end of said handle for longitudinal reciprocal movement of said shovel blade along a longitudinal axis;

an air hammer having a forward end and a rearward end, slidably supported within said bracket for forcing said shovel blade into a forward motion;

a drive rod having a first end and a second end, wherein the first end of said drive rod is connected to the forward end of said air hammer;

a pair of washers located between the second end of said drive rod and the rearward end of said shovel blade;

wherein the drive rod enables said washers to engage the shovel blade thereby allowing a forward motion of said shovel blade along a longitudinal axis;

means for connecting and regulating an external air supply to said air hammer comprising;

an air inlet, located at said rearward end of said handle, for removable connection to an external air line connected to the external air supply;

a substantially internal air line connecting said air inlet to said air hammer; and a trigger mechanism fixedly attached to said rearward end of said handle for operation control of airflow to said air hammer, wherein said trigger mechanism is connected to a valve for controlling the amount of pressure applied to said air hammer.

2. The roofing shovel as defined in claim 1, further comprises:

an elastomeric bumper, for reducing noise and shock, at said rearward end of said air hammer.

3. The roofing shovel as defined by claim 1 wherein said forward end of said shovel has a plurality of notches formed therein for allowing said shovel to pry roofing materials from a roof structure.

4. The roofing shovel as defined by claim 3 wherein said shovel blade has a fulcrum attached to said underside for aiding in prying operations.

5. A hand held and operated pneumatic roofing shovel comprising:

a shovel blade, having an underside, a flat forward end, and a rearward end, wherein said rearward end comprises a reinforced hollow shank;

a handle, having a forward end and a rearward end;

a bracket for slidably coupling said shank of said shovel blade to said handle for reciprocal longitudinal movement of said shovel blade comprising;

a hollow cylindrical body having a forward end and a rearward end, a shank receiving collar on said forward end of said hollow cylindrical body for receiving and supporting the shank of said shovel blade, and a handle receiving collar on said rearward end of said hollow cylindrical body for slidably coupling the forward end of said handle to said bracket;

an air hammer having a forward end and a rearward end, slidably supported within said bracket for forcing said shovel blade into a forward motion;

a drive rod having a first end and a second end, wherein the first end of said drive rod is connected to the forward end of said air hammer;

a pair of washers located between the second end of said drive rod and the rearward end of said shovel blade;

wherein the drive rod enables said washers to engage the shovel blade thereby allowing a forward motion of said shovel blade along a longitudinal axis;

means for connecting and regulating an external air supply to said air hammer comprising;

an air inlet, located at said rearward end of said handle, for removable connection to an external air line connected to the external air supply;

a substantially internal air line connecting said air inlet to said air hammer; and a trigger mechanism fixedly attached to said rearward end of said handle for operation control of airflow to said air hammer, wherein said trigger mechanism is connected to a valve for controlling the amount of pressure applied to said air hammer.

6. The roofing shovel as defined in claim 5 wherein said hollow cylindrical body has a removable access panel allowing for installation and removal of said air hammer.

7. The roofing shovel as defined in claim 5, further comprises:

an elastomeric bumper, for reducing noise and shock, at said rearward end of said air hammer.

8. The roofing shovel as defined by claim 5 wherein said forward end of said shovel has a plurality of notches formed therein for allowing said shovel to pry roofing materials from a roof structure.

9. The roofing shovel as defined by claim 8, wherein said shovel blade has a fulcrum attached to said underside for aiding in prying operations.

* * * * *